United States Patent [19]

Michael

[11] Patent Number: 5,041,020

[45] Date of Patent: Aug. 20, 1991

[54] F SERIES COAXIAL CABLE ADAPTER

[75] Inventor: George W. Michael, Harrisburg, Pa.

[73] Assignee: AMP Incorporated, Harrisburg, Pa.

[21] Appl. No.: 550,414

[22] Filed: Jul. 10, 1990

[51] Int. Cl.[5] ..... H01R 13/00

[52] U.S. Cl. ..... 439/578

[58] Field of Search ..... 439/578–585

[56] References Cited

U.S. PATENT DOCUMENTS

| | | | |
|---|---|---|---|
| 3,366,920 | 11/1965 | Laudig et al. | 339/177 |
| 3,486,161 | 12/1969 | Kraus et al. | 439/578 |
| 3,622,939 | 2/1970 | Forney, Jr. | 339/89 |
| 3,757,278 | 9/1973 | Schumacher | 339/177 R |
| 4,070,751 | 1/1977 | Hogendobler et al. | 29/628 |
| 4,206,963 | 3/1979 | English et al. | 339/147 R |
| 4,431,225 | 2/1984 | Banning | 439/578 |
| 4,619,496 | 9/1984 | Forney, Jr. et al. | 339/177 R |
| 4,668,043 | 5/1987 | Saba et al. | 439/585 |
| 4,690,481 | 9/1987 | Randolph | 439/585 |

*Primary Examiner*—Joseph H. McGlynn
*Attorney, Agent, or Firm*—Gerald K. Kita

[57] ABSTRACT

A coaxial connector 1 comprises, a conductive electrical contact 2 for connection with a signal conductor 7 of an electrical cable 6, a conductive shell 3 concentrically encircling the contact 2 for connection with a conductive shield 9 of the cable 6, insulation 4 concentrically between the contact 2 and the shell 3, a reduced diameter portion of the contact 2 for connection with the signal conductor 7, and impedance compensation is provided by a relatively enlarged diameter portion 25 of the insulation 4 receiving concentrically a relatively enlarged air gap 64 and the reduced diameter portion of the contact 2, and a reduced diameter portion 26 of the insulation 4 receiving concentrically an enlarged diameter portion 40 of the contact 2 and restraining the contact 2 from forward movement.

12 Claims, 2 Drawing Sheets

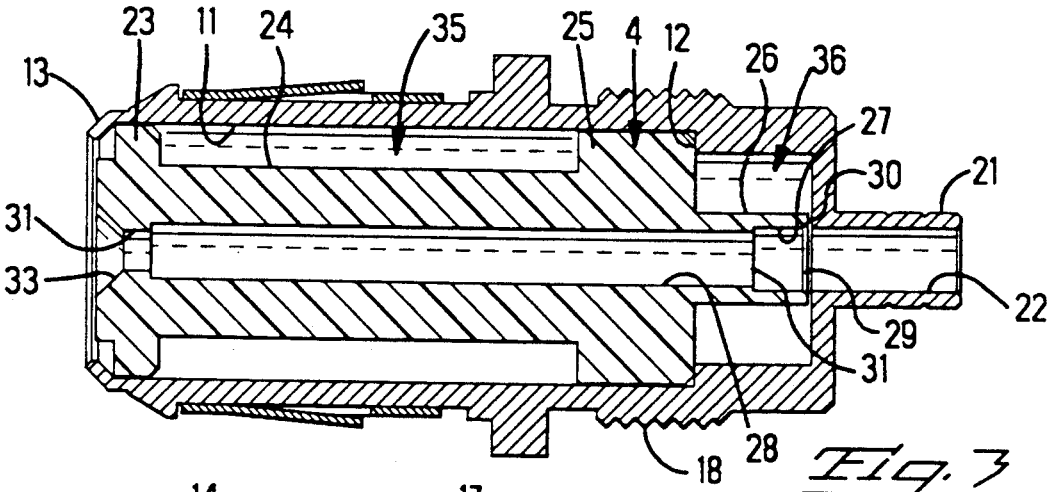
Fig. 3
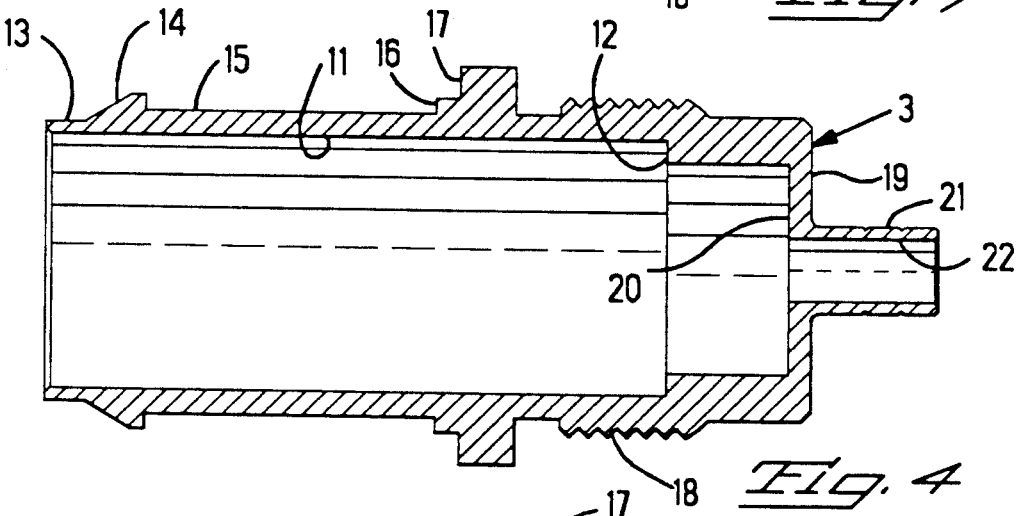
Fig. 4
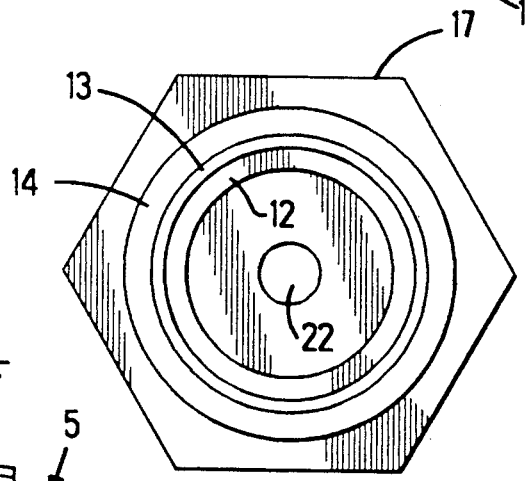
Fig. 5
Fig. 6
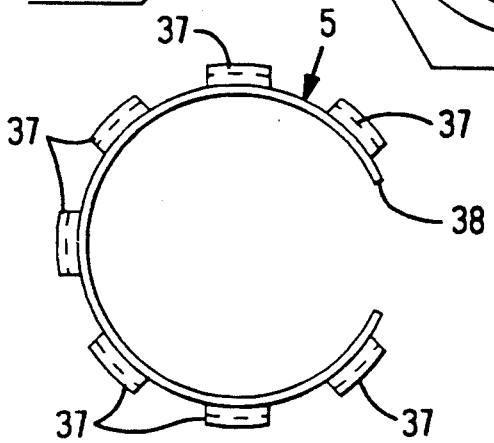
Fig. 7
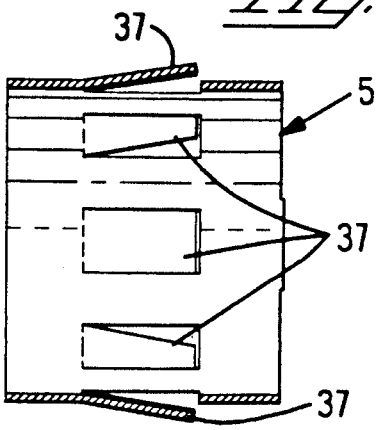

F SERIES COAXIAL CABLE ADAPTER

FIELD OF THE INVENTION

The invention relates to an electrical coaxial connector, and, more particularly, to a coaxial connector for coupling two coaxial cables.

BACKGROUND OF THE INVENTION

A coaxial connector has an engineering attribute known as a characteristic impedance. The characteristic impedance is a quantified value from which can be determined the amount of propagation delay that the connector will impart to an electrical signal of a given frequency. A desired characteristic impedance should be matched as closely as practicable throughout the length of the coaxial connector along which the electrical signal propagates.

A construction of a coaxial connector that provides impedance compensation, refers to an intentional construction of the connector that compensates for an undesired impedance mismatch due to insulation materials with different dielectric constants in the radial or diametric space between the contact and the concentric shell, and due to a change in the diametric dimension separating the contact and the concentric shell.

A coaxial connector disclosed in U.S. Pat. No. 3,366,920, is constructed with impedance compensation. Portholes are provided in the connector through which a tool enters to apply crimping forces. The portholes provide air gaps for atmospheric air that has a different dielectric constant than those of solid dielectric materials used to construct the connector. Impedance compensation is provided, after the crimping forces have been applied, by assembling a bushing having insulative ribs that extend into the portholes to replace atmospheric air with solid dielectric material.

A coaxial connector known from U.S. Pat. No. 3,757,278, comprises, a conductive electrical contact for connection with a signal conductor of an electrical cable, a conductive shell concentrically encircling the contact for connection with a conductive shield of the cable, and insulation concentrically between the contact and the shell. The contact is assembled by movement into a rear of the shell, and registers against a rear of a dielectric sleeve, and thereby is restrained from movement.

SUMMARY OF THE INVENTION

An advantage of the invention resides in a coaxial connector that provides impedance compensation by an enlarged diameter portion of insulation receiving concentrically a reduced diameter portion of the contact, and by an air gap concentric with a reduced diameter portion of the insulation receiving an enlarged diameter portion of the contact.

A further advantage resides in a coaxial connector in which a conductive contact is covered over its length by solid insulation in a space concentrically between the contact and a conductive shell, and corresponding air gaps are concentrically in the space together with the insulation to provide impedance compensation.

A further advantage of the invention resides in a coaxial connector that comprises, a conductive electrical contact for connection with a signal conductor of an electrical cable, a conductive shell concentrically encircling the contact for connection with a conductive shield of the cable, insulation concentrically between the contact and the shell, a reduced diameter portion of the contact for connection with the signal conductor, the contact having an exterior sized to pass through a rear of the shell forward into the insulation, and an enlarged diameter portion of the insulation receiving concentrically the reduced diameter portion of the contact, and a reduced diameter portion of the insulation receiving concentrically an enlarged diameter portion of the contact and restraining the contact from forward movement.

The invention will now be described, by way of example, from the following detailed description, taken in conjunction with the accompanying drawings.

DESCRIPTION OF THE DRAWINGS

FIG. 3 is an enlarged elevation view in section of a portion of the connector shown in FIG. 1.

FIG. 4 is an enlarged elevation view in section of a conductive shell of the connector shown in FIG. 1.

FIG. 5 is an end view of the shell shown in FIG. 4.

FIG. 6 is an enlarged elevation view in section of a conductive spring.

FIG. 7 is an end view of the spring shown in FIG. 6.

DETAILED DESCRIPTION

Figure 1:
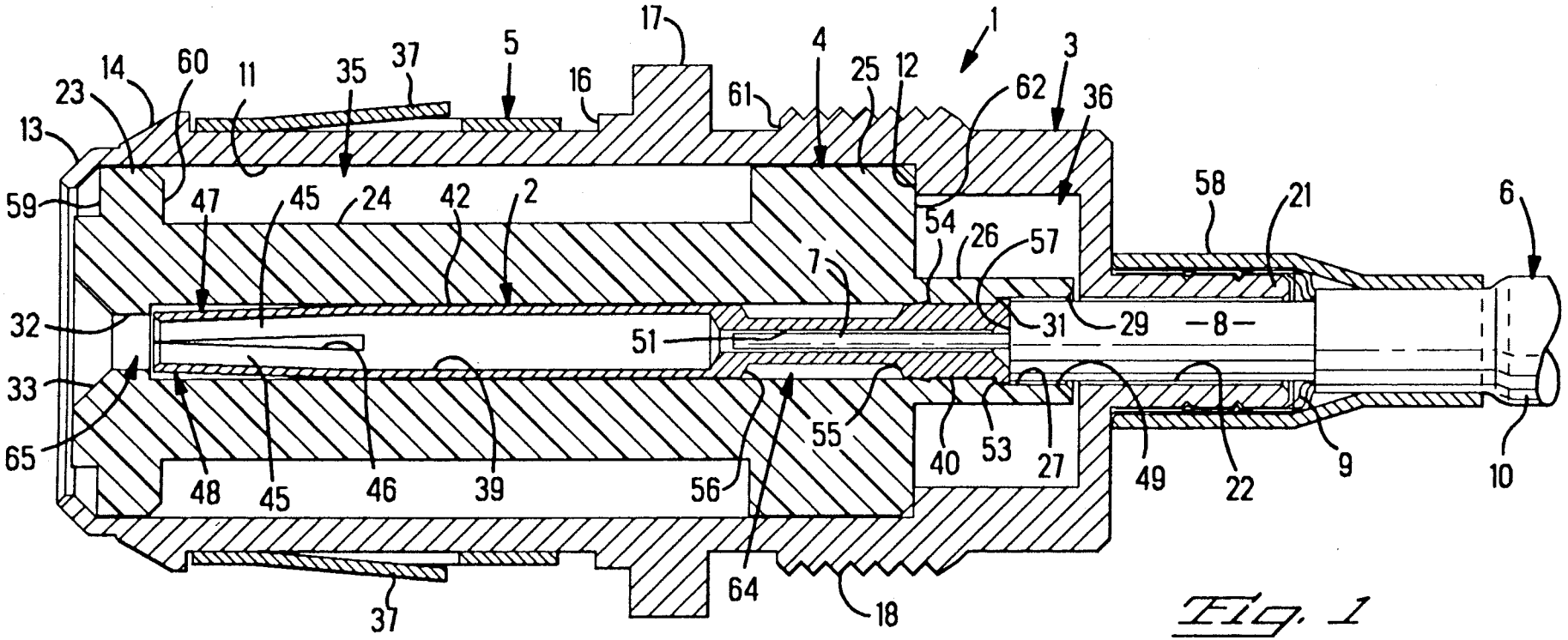
FIG. 1 is an enlarged elevation view in section of an electrical connector assembled to an electrical cable.

With reference to FIG. 1, a coaxial connector 1 comprises a conductive electrical contact 2, a conductive shell 3 concentrically encircling the contact 2 and insulation 4 extending over the entire length of the contact 2 concentrically between the contact 2 and the shell 3. A conductive outer contact 5 encircles the shell 3. The connector 1 is constructed for connection with a coaxial cable 6.

The cable 6 includes a conductive signal conductor 7 concentrically encircled by a flexible dielectric 8, in turn, concentrically encircled by a conductive shield 9, in turn, concentrically encircled by an insulative, outer jacket 10. The cable 6 is trimmed to project the signal conductor 7, the dielectric 8 and the shield 9 from the end of the jacket, as shown in FIG. 1.

With reference to FIG. 4, the shell 3 is generally cylindrical with a stepped cylindrical interior 11 having at least one forward facing shoulder 12 of ring shape. A thin walled lip 13 on the front end is forward of an exterior, frusto conical nose 14. A cylindrical portion 15 with a reduced diameter exterior extends rearward from the nose 14 to an exterior, raised shoulder 16. An external flange 17 of hexagonal cross section receives a wrench, not shown. Rearward of the flange 17 are external, raised threads 18 for receiving a threaded nut, not shown. A rear end 19 of the shell 3 includes a transverse end wall 20 intersected by a reduced diameter sleeve portion 21 with a hollow interior 22 concentric with the longitudinal, central axis of the shell 3.

With reference to FIGS. 1 and 3, the insulation 4 is of unitary construction with an enlarged diameter, cylindrical front portion 23, a span 24 of reduced diameter extending between the front portion 23 and a cylindrical, enlarged diameter portion 25. A rear portion 26 of reduced diameter has a cylindrical interior 27 formed by a stepped bore 28 along the longitudinal axis has a flared entry 29 at a rear end 30 of the insulation 4, a rear facing shoulder 31 within the rear portion 26, and a reduced diameter opening 32 at the front portion 23 having a flared funnel entry 33.

The insulation 4 is assembled in the front end 34 of the shell 3 with the front portion 23 and the enlarged diameter portion 25 supported concentrically against the interior 11 of the shell 3, and with the span 24 radially spaced from the shell 3 by a corresponding first air gap 35. The rear portion 26 is radially spaced from the shell 3 by a corresponding second air gap 36. The open interior 27 of the rear portion is aligned axially with the open interior 22 of the sleeve portion 21 of the shell 3. The enlarged diameter portion 25 engages the shoulder 12 of the shell 3 to limit rearward movement of the insulation 4. The lip 13 of the shell 3 is then bent radially inward to extend at a slope similar to that of the nose 14.

With reference to FIGS. 6 and 7, the outer contact 5 is of unitary construction, for example, of beryllium copper material, and is formed with multiple tines 37 that are partially severed from the thickness of the material, and are bent to project at a slope out of the thickness of the material. The contact 5 is formed into a ring with an open side 38 through which is received the cylindrical portion 15 of the shell 3. The outer contact 5 concentrically encircles and frictionally engages the cylindrical portion 15 to establish an electrical connection. The tines 37 project radially outward of the shell 3 to establish electrical contact with a complementary connector, not shown.

Figure 2:
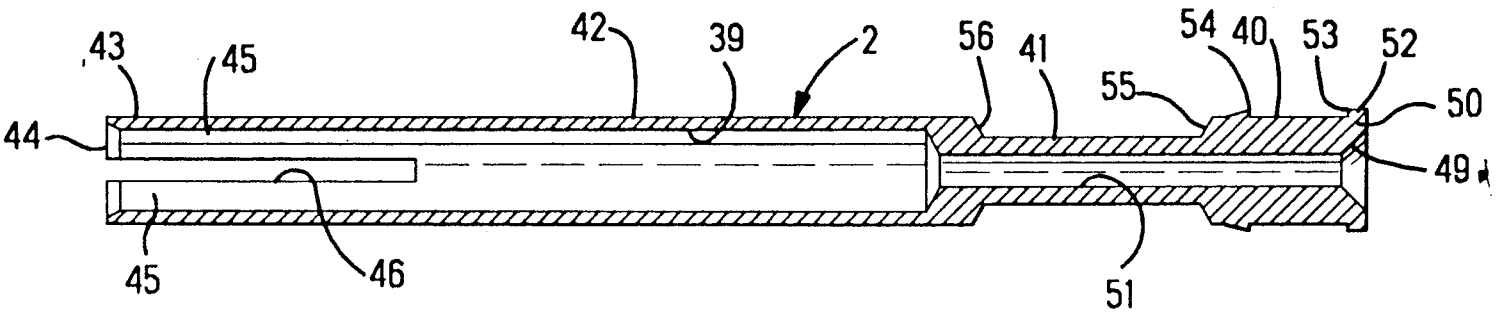
FIG. 2 is an enlarged elevation view in section of a conductive contact of the connector shown in FIG. 1.

With reference to FIG. 2, the contact 2 is of unitary construction with a longitudinal bore 39 extending concentrically through a relatively enlarged diameter, rear portion 40, a reduced diameter portion 41 forward of the rear portion 40, and an enlarged diameter, front portion 42. The front end 43 has an open front end 44 encircled by multiple resilient fingers 45 defined between multiple slots 46 that communicate with the front end 43 and extend longitudinally. The ends of the fingers 45 are bent inward radially toward one another, as shown in FIG. 1 at 47, and provide an electrical socket 48 for disconnectable coupling with a conductive pin, not shown. Receipt of the pin into the front end 43 will deflect the fingers 45 radially outward.

A flared funnel entry 49 of the bore at a rear end 50 of the contact 2 opens into a passage 51 for receiving the conductor 7 of the cable 6. The rear portion 40 is of enlarged external diameter, and has an enlarged diameter, external flange 52 with a ring shaped, forward facing, shoulder 53. Forward of the flange 52, the rear portion 40 includes an external, frusto conical barb 54 inclined rearward. A front 55 of the rear portion 40 is radially sloped. A rear 56 of the front portion 43 also is radially sloped. The contact 2 is assembled to the cable 6. The conductor 7 of the cable 6 extends through the entry 49 and along the passage 51. An end 57 of the dielectric 8 engages the rear end 50 of the contact 2 to limit forward movement of the conductor 7 with respect to the contact 2. The reduced diameter portion 41 is secured to the conductor 7 of the cable 6, for example, by the application of compressive force radially applied on the reduced diameter portion 41 to deform the same radially inward against the conductor 7 and provide a crimped electrical connection. Thereafter the contact 2 and the cable 6 are assembled to the insulation 4 and the shell 3.

The contact 2 has an exterior sized to pass through the rear, sleeve portion 21 of the shell 3 and forward into the insulation 4. The forward facing shoulder 53 of the flange 52 engages the rear facing shoulder 31 of the insulation 4 to limit forward movement of the contact 2. The rearward facing barb 54 is inserted along the insulation 4 with an interference fit, and impales in the insulation 4 to limit rearward movement of the contact 2. Thereby, the contact 2 is locked to the insulation 4. The socket 48 of the contact 2 is accessible through the opening 32 of the insulation 4. The conductive shield 9 of the cable 6 is positioned against the exterior of the sleeve portion 21 of the shell 3. A deformable crimping ring 58 is deformed inward radially over the shield 9 to clamp the shield 9 against the sleeve portion 21 and, thereby, to provide an electrical connection. The crimping ring 58 is radially deformed over the jacket 10 of the cable 6, and radially grips the jacket 10 to provide a strain relief.

The connector 1 provides impedance compensation. Each of the abrupt radial surfaces 59, 60, 61, 62 of the insulation 4 provides an abrupt change in the dielectric constant of the insulative material 4 in the diametric space 63 between the contact 2 and the shell 3. This abrupt change would cause impedance mismatch in the absence of impedance compensation. Each of the radially sloped exterior surfaces 55, 56 of the contact 2 provides a gradual change in air mass in a corresponding third air gap 64 concentrically between the contact 2 and the insulation 4. Each gradual change in air mass is concentric with a corresponding abrupt radial surface 61, 62 and compensates for the abrupt change in the dielectric constant due to the insulation 4 at the ends of the corresponding air gaps 35 and 36. The impedance compensation is efficiently achieved, since the gradual change is accomplished by an intentional construction of the dielectric having the lowest dielectric constant. The dielectric having the lowest dielectric constant is air, which has a dielectric constant lower than that of the solid insulation 4.

A change in the diameter of the contact 2 will cause a corresponding change in the diameter of the space 63 separating the contact 2 and the concentric shell 3. Impedance compensation is provided when the diameter of the insulation 4 and the diameter of the corresponding, concentric air gap 35, 36 are changed proportionately.

With reference to FIG. 1, impedance compensation will now be discussed. The enlarged diameter portion 25 of the insulation 4 is constructed specifically to extend concentrically and longitudinally along a corresponding reduced diameter portion 41 of the contact 2. Thereby, the corresponding third air gap 64 is provided between the contact 2 and the insulation 4. The corresponding third air gap 64 is concentric with the enlarged diameter portion 25 of the insulation 4 and provides impedance compensation.

The enlarged diameter portion 23 of the insulation 4 is forward of the 47 end of the socket 48 to provide a corresponding fourth air gap 65 that will be filled only partially by a conductive pin, not shown, of external diameter less than that of the socket 48. The air gap 65 is concentric with the enlarged diameter portion 23 and provides impedance compensation.

A corresponding increase in the diameter of the contact 2 causes a corresponding reduction in the diametric space 63 separating the contact 2 and the concentric shell 3. The reduced space 63 requires a reduction in the diameter of the insulation 4 and a corresponding increase in the diameter of the air mass, thereby to provide impedance compensation. Thus, the insulation 4 is of reduced diameter along the span 24, and span 24 is concentrically spaced from the shell 3 by the corresponding first air gap 35 proportionately enlarged in diameter when concentric with the span 24, and with the enlarged diameter, front portion 42 of the contact 2. Similarly, the rear portion 26 is a reduced diameter portion of the insulation 4 that is concentric with the enlarged diameter, rear portion 40 of the contact 2, and with the corresponding air gap 64 of larger diameter than that of the remainder of the air gap 64 separating the remainder of the contact 2 and the insulation 4.

I claim:

1. A coaxial connector comprising: a conductive electrical contact for connection with a signal conductor of an electrical cable; a conductive shell concentrically encircling the contact for connection with a conductive shield of the cable; insulation concentrically between the contact and the shell; a reduced diameter portion of the contact of substantially constant outer diameter for connection with the signal conductor; a relatively enlarged outer diameter portion of the insulation concentrically extending over the reduced diameter portion of the contact and being constructed for impedance matching; and a reduced diameter portion of the insulation receiving concentrically an enlarged diameter portion of the contact of substantially constant outer diameter, and thereby being constructed for impedance matching; and the reduced diameter portion of the insulation restraining the contact from forward movement.

2. A coaxial connector as recited in claim 1, comprising: a front end of the insulation being supported concentrically against an interior of the shell, a substantially constant outer diameter of the contact extending concentrically along a span of the insulation extending rearward of the front end, the span being concentrically spaced from the shell by a corresponding air gap and thereby being constructed for impedance matching, the reduced diameter portion of the contact being spaced from the interior of the insulation by a corresponding air gap and thereby being constructed for impedance matching, and a reduced diameter sleeve portion of the shell for connection to the shield of the cable having an interior aligned with an interior of the insulation.

3. A coaxial connector as recited in claim 1, comprising: an enlarged diameter portion of the insulation being concentric with the reduced diameter portion of the contact and being separated therefrom by a corresponding air gap and thereby being constructed for impedance matching, and a reduced diameter rear portion of the insulation being concentric with the rear portion of the contact and being spaced concentrically from the interior of the shell by a corresponding air gap and thereby being constructed for impedance matching.

4. A coaxial connector as recited in claim 1, comprising: a front end of the insulation being concentrically supported against the interior of the shell and having a concentric opening, a longitudinal span of the insulation between the front end and the rear portion being concentrically spaced from the interior of the shell by a corresponding air gap and thereby being constructed for impedance matching, the contact extending concentrically of the span and having a front end accessible through the opening.

5. A coaxial connector as recited in claim 1, comprising:

a reduced diameter sleeve portion of the shell having an interior aligned with the interior of the insulation, the contact having an exterior sized for movement through the interior of the sleeve portion and along the interior of the insulation.

6. A coaxial connector as recited in claim 1, comprising: the insulation extending over the contact, and reduced diameter portions of the insulation being concentric with corresponding increased diameter portions of the contact and thereby being constructed for impedance matching.

7. A coaxial connector as recited in claim 1, comprising: the shell is of unitary construction, the insulation is of unitary construction and the contact is of unitary construction.

8. A coaxial connector as recited in claim 1, comprising: an inclined nose on the shell, and a lip forward of the nose inclined radially inward over a front end of the insulation.

9. A coaxial connector as recited in claim 1, comprising: the reduced diameter portion of the contact is forward of the enlarged diameter portion of the contact.

10. A method for assembling a coaxial connector, comprising the steps of: inserting unitary insulation within a conductive shell, assembling a conductive contact to a signal conductor of a coaxial cable, inserting the contact and the cable through an open rear end of the shell and into an open rear end of the insulation, and positioning a reduced diameter portion of the contact concentrically with an enlarged diameter portion of the insulation and a corresponding air gap, and positioning an enlarged diameter portion of the contact concentrically with a reduced diameter portion of the insulation and a corresponding air gap, wherein concentric diameters of the insulation and each of the corresponding air gaps vary in proportion to a diametric space between the contact and the shell for impedance matching construction.

11. A method as recited in claim 10, comprising the steps of: deflecting a front lip of the shell inward radially over a front end of the insulation.

12. A method as recited in claim 10, comprising the steps of: supporting the enlarged diameter portion of the insulation against an interior of the shell, and positioning the reduced diameter portion of the insulation rearward of the enlarged diameter portion of the insulation and in alignment with the rear end of the shell.

* * * * *